US006837130B2

(12) United States Patent
Turner et al.

(10) Patent No.: US 6,837,130 B2
(45) Date of Patent: Jan. 4, 2005

(54) METHOD OF REPOSITIONING A BEVELED EDGE OF A CUTTING BLADE

(75) Inventors: Darrel Lee Turner, Reeseville, WI (US); Gary John Kutzler, Watertown, WI (US)

(73) Assignee: Fisher Barton, Inc., Watertown, WI (US)

( * ) Notice: Subject to any disclaimer, the term of this patent is extended or adjusted under 35 U.S.C. 154(b) by 37 days.

(21) Appl. No.: 10/082,909

(22) Filed: Feb. 26, 2002

(65) Prior Publication Data

US 2003/0159542 A1 Aug. 28, 2003

(51) Int. Cl.[7] ..... B21K 5/00
(52) U.S. Cl. ..... 76/115; 76/104.1
(58) Field of Search ..... 76/115, 104.1, 76/101.1; 72/412, 379.2

(56) References Cited

U.S. PATENT DOCUMENTS 4,262,559 A * 4/1981 Bergan ..... 76/115
5,201,253 A * 4/1993 Lazarchik et al. ..... 76/116

OTHER PUBLICATIONS

E–Mail Exchange, dated Nov. 5, 1999, Dec. 7, 1999, and Dec. 9, 1999, with Statement of Relevance.

* cited by examiner

*Primary Examiner*—Douglas D Watts
(74) *Attorney, Agent, or Firm*—Michael Best & Friedrich LLP

(57) ABSTRACT

A method of manufacturing a cutting blade includes providing a blank that is to be formed into a cutting blade. The blank has a top surface, a bottom surface, and a first edge extending between the top and bottom surfaces. The method further includes forming a bevel on the first edge, the bevel defining a cutting edge in a first location with respect to the top and bottom surfaces, and then repositioning the cutting edge of the bevel on the first edge to a second location with respect to the top and bottom surfaces. Preferably, forming the bevel includes one of milling, coining, shearing, and rolling the first edge, and repositioning the cutting edge includes changing the orientation of the bevel using a stamping die.

46 Claims, 3 Drawing Sheets

Fig. 3
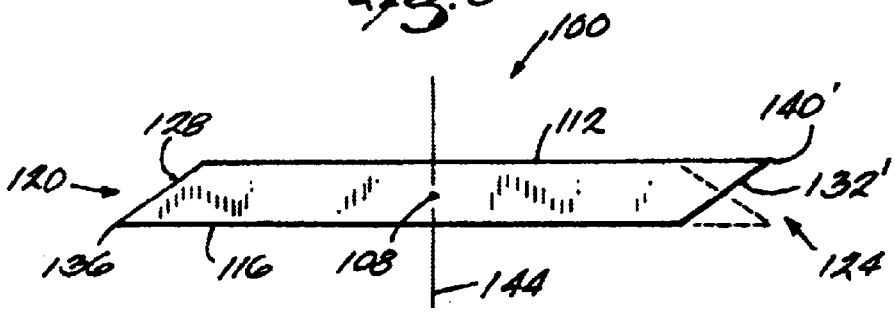
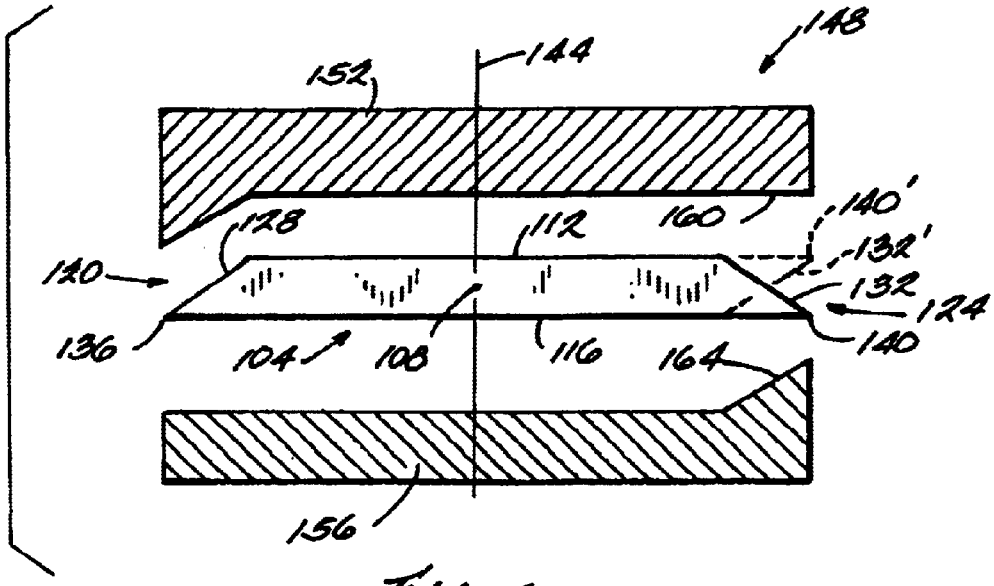
Fig. 4

METHOD OF REPOSITIONING A BEVELED EDGE OF A CUTTING BLADE

FIELD OF THE INVENTION

The invention relates to cutting blades, and more particularly to the method of manufacturing cutting blades.

BACKGROUND OF THE INVENTION

Agricultural equipment of various types and sizes is used to cut vegetation ranging from grass to small trees. Different types of cutting blades are used on the various types of agricultural equipment, and many cutting blades include beveled edges that improve the cutting ability of the blades.

FIG. 1 illustrates a prior art cutting blade 10 having opposite edges 14 and 18 that are at least partially beveled. The portion of the blade 10 shown in solid lines represents a flail-type blade, however, as shown in phantom, the blade 10 could also be a symmetrical rotary cutting blade. As can be seen in FIG. 1, the edges 14 and 18 have symmetrical bevels 22 and 26, respectively, that decline outwardly from the top surface of the blade 10 toward the bottom surface of the blade 10 to define cutting edges 30 and 34 that extend longitudinally adjacent the bottom surface of the blade 10. The bevels 22 and 26 are substantially symmetrical about the blade's longitudinal axis 38.

It has also been known to bevel blades asymmetrically such that the cutting edge on one beveled edge of the blade is adjacent the bottom surface of the blade and the cutting edge on the other beveled edge of the blade is adjacent the top surface of the blade. FIG. 2 illustrates a blade 40 having this configuration. As seen in FIG. 2, the edge 44 has a bevel 48 substantially like the bevel 22 of FIG. 1, while the edge 52 has a bevel 56 that declines inwardly from the top surface of the blade 40 toward the bottom surface of the blade 40 such that the cutting edge 60 extends longitudinally adjacent the top surface of the blade 40. Thus, the bevels 48 and 56 are substantially asymmetrical about the blade's longitudinal axis 64.

Beveled edges can be formed using a variety of machining techniques, including milling, coining, and shearing. When manufacturing the cutting blade 10, both of the beveled edges 22 and 26 can be formed quickly and easily in one machine setup. When manufacturing the cutting blade 40, however, the bevels 48 and 56 on the blade 40 must be machined from opposite sides of the blade 40, requiring two separate machine setups. In other words, after the bevel 48 is machined, the blade must be removed from the machining device, turned over, and repositioned in the machining device before the bevel 56 can be machined. In addition to adding time and expense to the manufacture of the blades 40, this three-step process typically results in the formation of burrs, which dull the beveled cutting edges.

It has also been known to manufacture blades so that the cutting edge is positioned approximately midway between the top and bottom surfaces of the blade. This includes machining oppositely facing bevels on the same edge of the blade so that the two bevels intersect to create the cutting edge at approximately the midway point of the blade's material thickness. This configuration also requires the three-step machining process described above just to achieve the desired configuration for one edge of the blade.

One solution available for manufacturing the blade 40 without the added machining costs is to form the asymmetrical beveled edges during the initial hot-rolling of the metal, or in a secondary hot-rolling process. Blades having midpoint cutting edges can also be formed via rolling. While this rolling process can eliminate the burring and dulling experienced in the three-step machining process, it is still more costly and time consuming than the more efficient machining techniques commonly used to manufacture the bevels.

SUMMARY OF THE INVENTION

It is therefore desirable to develop an improved method of manufacturing cutting blades having asymmetrical beveled edges or beveled edges having a cutting edge positioned between the top and bottom surfaces of the blade. The method of the present invention provides the ability to reposition existing symmetrical beveled edges to achieve any desired blade configuration.

Preferably, the inventive method utilizes a progressive stamping die or other machinery to reposition a beveled edge that was previously formed using the milling, coining, shearing, or rolling techniques described above. With this method, the cutting edge of a beveled surface can be repositioned quickly and inexpensively, without damaging or dulling the cutting edge, without cracking the part, and while maintaining consistent bevel angles. Furthermore, the blade does not need to be turned over between the beveling operation and the repositioning operation. Therefore, manufacturing blades with asymmetrical beveled edges or with beveled edges having a cutting edge positioned between the top and bottom surfaces of the blade is greatly facilitated.

More specifically, the invention provides a method of manufacturing a cutting blade. The method includes providing a blank that is to be formed into a cutting blade, the blank having a top surface, a bottom surface, and a first edge extending between the top and bottom surfaces. The method further includes forming a bevel on the first edge, the bevel defining a cutting edge in a first location with respect to the top and bottom surfaces, and then repositioning the cutting edge of the bevel on the first edge to a second location with respect to the top and bottom surfaces.

In one aspect of the invention, forming the bevel includes one of milling, coining, shearing, and rolling the first edge, and repositioning the cutting edge includes changing the orientation of the bevel using a stamping die. In another aspect of the invention, the forming step occurs at a first station, the repositioning step occurs at a second station, and the blank is not turned over between the forming step and the repositioning step.

The invention also provides a method of manufacturing a cutting blade. The method includes providing a blank that is to be formed into a cutting blade, the blank having a top surface, a bottom surface, and first and second edges extending between the top and bottom surfaces. The method further includes forming bevels on each of the first and second edges, the bevels being substantially symmetrical with respect to a plane extending through the blank, and then repositioning one of the bevels such that the bevels are no longer substantially symmetrical with respect to the plane extending through the blank.

The invention further provides a cutting blade having a top surface, a bottom surface, a first edge extending between the top and bottom surfaces, and a bevel formed on the first edge, the bevel defining a cutting edge. The blade is manufactured according to the method including forming the bevel on the first edge, and reorienting the bevel such that the cutting edge is repositioned from a first location with respect to the top and bottom surfaces, to a second location with respect to the top and bottom surfaces. In one aspect of the invention, the first position is adjacent the bottom surface and the second position is either adjacent the top surface or between the top and bottom surfaces.

Other features and advantages of the invention will become apparent to those skilled in the art upon review of the following detailed description, claims, and drawings.

BRIEF DESCRIPTION OF THE DRAWINGS

FIG. 3 is a partial end view of a blade having asymmetrical beveled edges formed by the method embodying the invention.

FIG. 4 is a partial end view of a blank positioned in a stamping die prior to being formed into the blade of FIG. 3.

Figure 1:
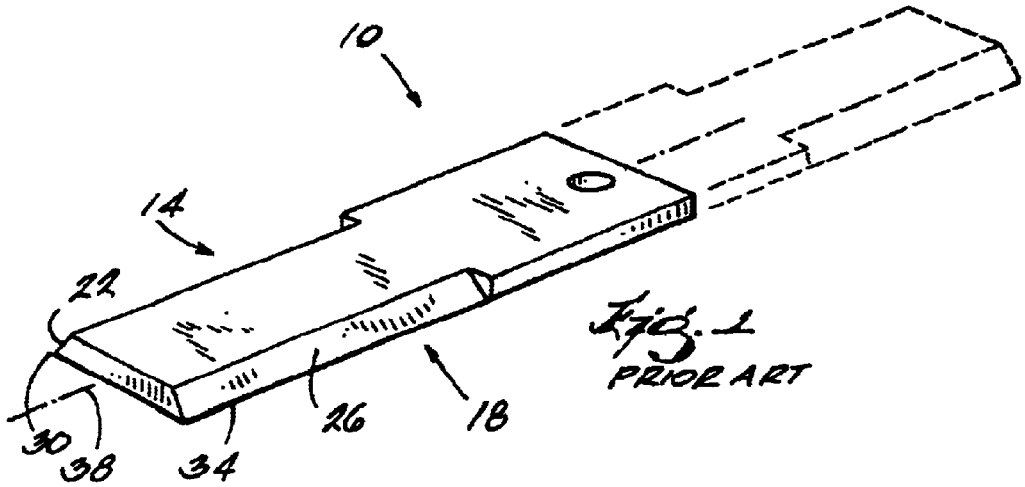
Fig. 1 PRIOR ART
FIG. 1 is a perspective view of a prior art cutting blade having symmetrical beveled edges.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

FIG. 3 illustrates a cutting blade 100 manufactured according to the present invention. The blade 100 has a substantially similar configuration (as indicated by the solid lines) to the blade 40 shown in FIG. 2, however, according to the present invention, the blade 100 was initially similar in configuration (as indicated by the dashed lines) to the blade 10 of FIG. 1. The blade 100 can be a flail-type blade, as is typically used in straw-choppers and vegetation clearing devices, or can be a symmetrical rotary cutting blade, as is typically used in lawnmowers. Other types of blades can also be made according to the method of the invention.

Figure 2:
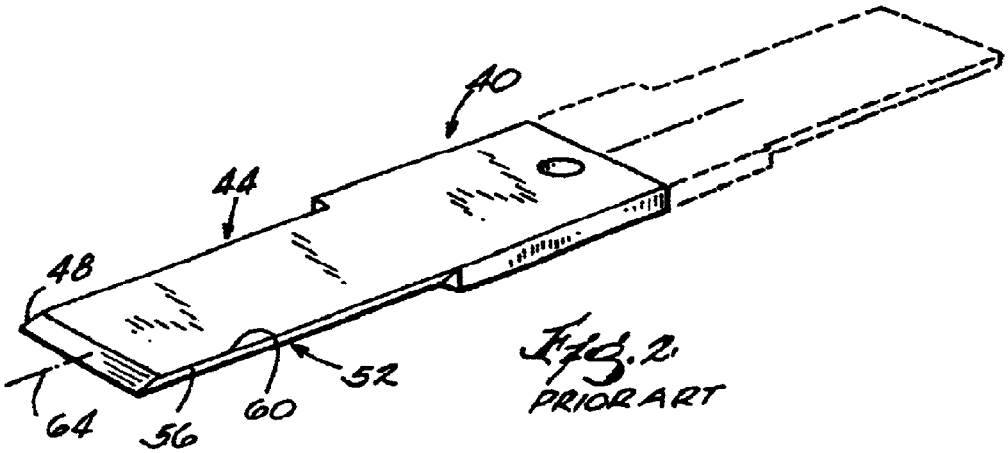
Fig. 2. PRIOR ART
FIG. 2 is a perspective view of a prior art cutting blade having asymmetrical beveled edges.

Referring to FIG. 4, a blank 104 is illustrated as having a similar configuration (as indicated by the solid lines) to the blade 10 shown in FIG. 1. The blank 104 has a longitudinal axis 108 (shown extending into the page) that is oriented in the same manner as the longitudinal axis 38 in FIG. 1. The blank 104 further includes a top surface 112, a bottom surface 116, and spaced-apart beveled edges generally indicated by the arrows 120 and 124. In the illustrated embodiment, the edges 120 and 124 extend between the top and bottom surfaces 112, 116 in a direction substantially parallel to the longitudinal axis 108. Of course, the edges 120 and 124 need not extend substantially parallel to the longitudinal axis 108, but rather could extend at some angle with respect to the longitudinal axis 108 or could be curved.

The edges 120 and 124 include respective first and second beveled surfaces 128 and 132. The beveled surfaces 128, 132 are preferably machined by milling, coining, shearing, rolling, or other suitable methods. In a preferred embodiment, the beveled surfaces 128, 132 are formed using a one-step shearing process in which both beveled surfaces 128 and 132 are formed substantially simultaneously at a first forming station.

As seen in FIG. 4, the beveled surface 128 defines a cutting edge 136 positioned adjacent the bottom surface 116 of the blank 104. Likewise, the beveled surface 132 defines a cutting edge 140 positioned adjacent the bottom surface 116 of the blank 104. Therefore, as shown in FIG. 4, the blank 104 has a configuration substantially similar to the blade 10 shown in FIG. 1, in that the beveled surfaces 128 and 132 are substantially symmetrical with respect to a plane 144 extending through the longitudinal axis 108. Using any of the machining techniques listed above, the beveled surfaces 128 and 132 can be machined in a single machine setup, wherein the blank 104 does not need to be turned over because the beveled surfaces are similarly oriented (declining outwardly from the top surface 112 to the bottom surface 116).

As represented in FIG. 4, the machined blank 104 is then positioned in a repositioning device such as a stamping die or other similar device represented generally at 148. Stamping dies 148 are well-known forming devices, and therefore, the construction and operation of a stamping die 148 will not be explained in detail. Preferably, the stamping die 148 is a second forming station adjacent the first forming station where the beveled surfaces 128, 132 are machined. The blank 104 can be moved manually or automatically from the first station, where the beveled surfaces 128, 132 are formed, to the stamping die 148, without turning over the blank 104.

As seen in FIG. 4, the stamping die 148 includes a top jaw 152 and a corresponding bottom jaw 156. The jaws 152 and 156 are configured to reposition or reorient at least one of the beveled surfaces 128, 132. In FIG. 4, for example, the beveled surface 132 and the cutting edge 140 can be repositioned or reoriented from the position shown in solid lines to a second position shown in dashed lines. The repositioned beveled surface 132' defines a cutting edge 140' that is adjacent the top surface 112 of the blank 104.

To achieve this repositioning or reorienting, the top jaw 152 includes a substantially planar surface 160, while the bottom jaw 156 includes a ramped surface 164. As the jaws 152 and 156 are closed around the blank 104, the ramped surface 164 engages the bottom surface 116 adjacent the beveled edge 124 and repositions the beveled edge 124 to the position shown in dashed lines. Note that the beveled edge 120 is not repositioned due to the configuration of the jaws 152 and 156 adjacent the beveled edge 120. Of course, it would be possible to reposition the beveled edge 120, if desired, by changing the configuration of the jaws 152 and 156 adjacent the beveled edge 120.

It should also be noted that the configurations of the planar surface 160 and the ramped surface 164 are shown for purposes of illustration only, and that other configurations could likely be used to optimize the stamping or reorienting process. The configuration of the jaws 152 and 156 can be optimized to achieve the desired bevel angles and to ensure that the beveled surfaces and cutting edges are not damaged, dulled, or cracked during repositioning. Additionally, multiple sets of jaws could be used to incrementally achieve the repositioning in multiple steps.

The cutting blade 100 shown in FIG. 3 results from the blank 104 that has gone through the repositioning process illustrated in FIG. 4. As illustrated in FIG. 3, the cutting blade 100 includes the beveled surface 128 defining the cutting edge 136 that is positioned adjacent the bottom surface 116 of the blade 100, and the beveled surface 132' defining the cutting edge 140' positioned adjacent the top surface 112 of the blade 100. Therefore, the blade 100 includes beveled surfaces 128 and 132' that are no longer symmetrical about the plane 144 extending through the longitudinal axis 108. Using the method of the present invention, it is possible to form the blade 100 quickly, easily, and accurately, without having to turn the blade over for a second bevel machining setup, as was previously required using the prior art forming techniques discussed above with respect to the blade 40.

Figure 5:
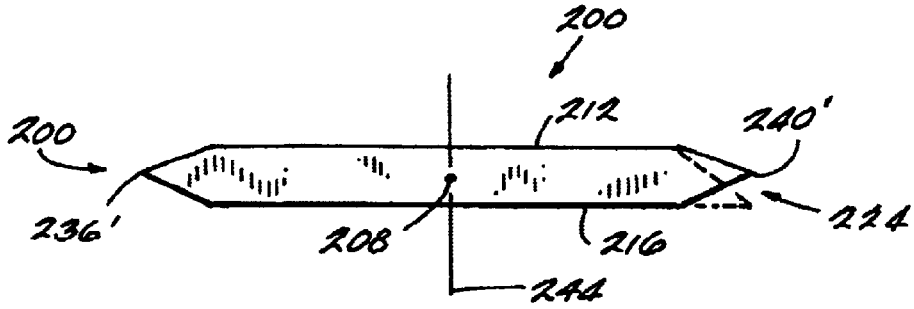
FIG. 5 is a partial end view of a blade having a beveled edge with a cutting edge positioned between the top and bottom surfaces of the blade and formed by the method embodying the invention.

FIG. 5 illustrates a cutting blade 200 that is also manufactured according to the method of the present invention. The blade 200 illustrated in FIG. 5 is also manufactured from a blank 204 substantially similar to the blank 104. Like parts have been given like reference numerals of the two-hundred series.

Figure 6:
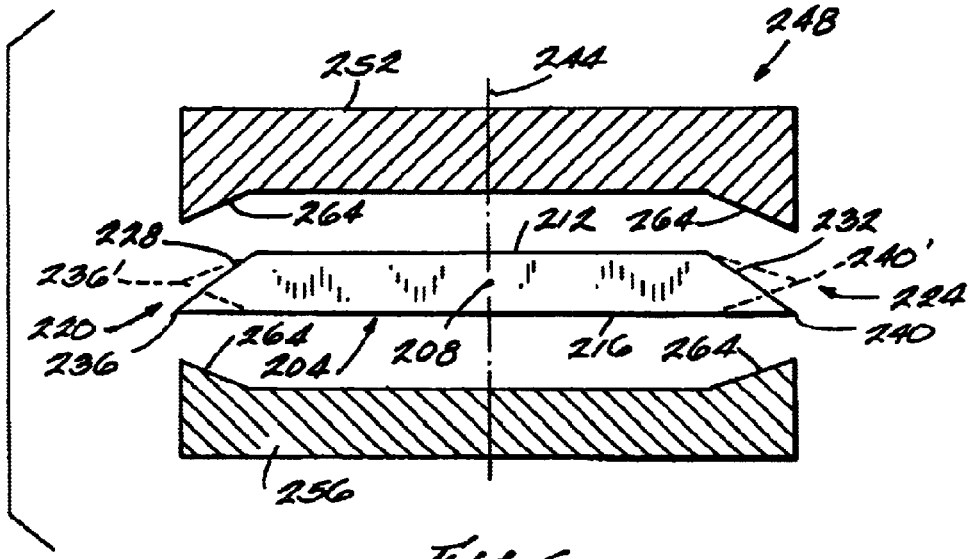
FIG. 6 is a partial end view of a blank positioned in a stamping die prior to being formed into the blade of FIG. 5.

As seen in FIG. 6, the blank 204 has symmetrical beveled edges 220 and 224 that were previously machined at a bevel forming station using the techniques previously discussed. The blank 204 is then positioned in a stamping die 248 having top and bottom jaws 252 and 256. The top and bottom jaws 252 and 256 are slightly different than the jaws 152 and 156 of FIG. 4, in that the jaws 252 and 256 are configured to reposition both beveled edges 220 and 224 from the original positions (shown in solid lines in FIG. 6) to a second position (shown in dashed lines in FIG. 6), wherein the cutting edges 236 and 240 are repositioned from a first position adjacent the bottom surface 216 of the blank 204 to a second position somewhere between the top surface 212 and the bottom surface 216.

As seen in FIG. 6, the jaws 252 and 256 each include spaced-apart ramped surfaces 264 adjacent both of the edges 220 and 224. The ramped surfaces 264 cooperate when the jaws 252 and 256 are closed so that the repositioned cutting edges 236' and 240' are substantially midway between the top and bottom surfaces 212 and 216, however, other locations for the repositioned cutting edges 236' and 240' can also be achieved by simply changing the configuration of the jaws 252 and 256.

While the method of the present invention has been described in relation to formation of the blades 100 and 200, it is understood that various modifications can be made to achieve other blade configurations. For example, while the blades 100 and 200 are shown as having two beveled edges 120, 124 and 220, 224, respectively, the method of the present invention can also be used for blades having only one beveled edge. Additionally, the method of the present invention can be used for manufacturing blades having different configurations than the blades 100 and 200, such as blades having curved beveled edges or beveled edges that are not substantially parallel to one another or to any longitudinal axis of the blade.

Furthermore, while the stamping dies 148 and 248 are described with respect to the repositioning of the beveled edges only, it should be understood that stamping dies are typically used to form other blade features, such as the contouring present on many blades to improve air flow and cutting characteristics. By incorporating the bevel repositioning process with the existing stamping processes, the contouring of the blade and the bevel repositioning can occur at a single stamping station, such that no additional stamping labor costs are required to reposition the beveled edges.

Various features of the invention are set forth in the following claims.

What is claimed is:

1. A method of manufacturing a cutting blade, the method comprising:

providing a blank that is to be formed into a cutting blade, the blank having a top surface, a bottom surface, and a first edge extending between the top and bottom surfaces;

forming a bevel on the first edge, the bevel defining a cutting edge in a first location on the first edge with respect to the top and bottom surfaces; and repositioning the cutting edge of the bevel on the first edge to a second location on the first edge with respect to the top and bottom surfaces;

wherein the first location is adjacent the bottom surface.

2. The method of claim 1, wherein the blank further includes a second edge extending between the top and bottom surfaces, and wherein the method further comprises:

forming a bevel on the second edge, the bevel defining a cutting edge in a first location on the second edge with respect to the top and bottom surface.

3. The method of claim 2, wherein repositioning the cutting edge of the bevel on the first edge does not reposition the cutting edge of the bevel on the second edge.

4. The method of claim 1, wherein forming the bevel includes one of milling, coining, shearing, and rolling the first edge.

5. The method of claim 1, wherein repositioning the cutting edge includes changing the orientation of the bevel using a stamping die.

6. The method of claim 1, wherein the second location is adjacent the top surface.

7. The method of claim 1, wherein the second location is between the top and bottom surfaces.

8. The method of claim 1, wherein the forming step occurs at a first station, and wherein the repositioning step occurs at a second station.

9. The method of claim 1, wherein the blank is not turned over between the forming step and the repositioning step.

10. A method of manufacturing a cutting blade, the method comprising:

providing a blank that is to be formed into a cutting blade, the blank having a top surface, a bottom surface, and first and second edges extending between the top and bottom surfaces;

forming bevels on each of the first and second edges, the bevels being substantially symmetrical with respect to a plane extending through the blank; and repositioning one of the bevels such that the bevels are no longer substantially symmetrical with respect to the plane extending through the blank.

11. The method of claim 10, wherein forming the bevels includes one of milling, coining, shearing, and rolling the first and second edges.

12. The method of claim 10, wherein repositioning one of the bevels includes changing the orientation of the bevel using a stamping die.

13. The method of claim 10, wherein the forming step occurs at a first station, and wherein the repositioning step occurs at a second station.

14. The method of claim 10, wherein the blank is not turned over between the forming step and the repositioning step.

15. A method of reorienting a bevel on a cutting blade, the blade having a top surface, a bottom surface, and a first edge extending between the top and bottom surfaces, the first edge including a bevel defining a cutting edge, the method comprising:

reorienting the bevel such that the cutting edge is repositioned from a first location on the first edge with respect to the top and bottom surfaces, to a second location on the first edge with respect to the top and bottom surfaces;

wherein the first location is adjacent the bottom surface.

16. The method of claim 15, wherein the second location is adjacent the top surface.

17. The method of claim 15, wherein the second location is between the top and bottom surfaces.

18. The method of claim 2, further including repositioning the cutting edge of the bevel on the second edge to a second location on the second edge with respect to the top and bottom surfaces.

19. The method of claim 18, wherein repositioning the cutting edge of the bevel on the second edge occurs substantially at the same time as the repositioning of the cutting edge of the bevel on the first edge.

20. The method of claim 15, wherein the blade further includes a second edge extending between the top and bottom surfaces, the second edge including a bevel defining a cutting edge, and wherein reorienting the bevel on the first edge does not reorient the cutting edge of the bevel on the second edge.

21. The method of claim 15, wherein the blade further includes a second edge extending between the top and bottom surfaces, the second edge including a bevel defining a cutting edge, the method further including reorienting the bevel on the second edge such that the cutting edge is repositioned from a first location on the second edge with respect to the top and bottom surfaces, to a second location on the second edge with respect to the top and bottom surfaces.

22. The method of claim 21, wherein reorienting the bevel on the second edge occurs substantially at the same time as the reorienting of the bevel on the first edge.

23. The method of claim 15, wherein reorienting the bevel includes changing the orientation of the bevel using a stamping die.

24. A method of manufacturing a cutting blade, the method comprising:

providing a blade having a top surface, a bottom surface, and first and second edges extending between the top and bottom surfaces, each of the first and second edges including a bevel defining a cutting edge; and repositioning the cutting edge of the bevel on the first edge from a first location on the first edge to a second location on the first edge;

wherein the first location is adjacent the bottom surface; and wherein repositioning the cutting edge of the bevel on the first edge does not reposition the cutting edge of the bevel on the second edge.

25. The method of claim 24, wherein repositioning the cutting edge of the bevel on the first edge is done using a stamping die.

26. The method of claim 24, wherein the second location is adjacent the top surface.

27. The method of claim 24, wherein the second location is between the top and bottom surfaces.

28. A method of manufacturing a cutting blade, the method comprising:

providing a blank that is to be formed into a cutting blade, the blank having a top surface, a bottom surface, and a first edge extending between the top and bottom surfaces;

forming a bevel on the first edge, the bevel defining a cutting edge in a first location on the first edge with respect to the top and bottom surfaces; and repositioning the cuffing edge of the bevel on the first edge to a second location on the first edge with respect to the top and bottom surfaces;

wherein the second location is between the top and bottom surfaces.

29. The method of claim 28, wherein the blank further includes a second edge extending between the top and bottom surfaces, and wherein the method further comprises:

forming a bevel on the second edge, the bevel defining a cutting edge in a first location on the second edge with respect to the top and bottom surface.

30. The method of claim 29, wherein repositioning the cutting edge of the bevel on the first edge does not reposition the cutting edge of the bevel on the second edge.

31. The method of claim 28, wherein forming the bevel includes one of milling, coining, shearing, and rolling the first edge.

32. The method of claim 28, wherein repositioning the cutting edge includes changing the orientation of the bevel using a stamping die.

33. The method of claim 28, wherein the first location is adjacent the bottom surface.

34. The method of claim 28, wherein the forming step occurs at a first station, and wherein the repositioning step occurs at a second station.

35. The method of claim 28, wherein the blank is not turned over between the forming step and the repositioning step.

36. The method of claim 29, further including repositioning the cutting edge of the bevel on the second edge to a second location on the second edge that is between the top and bottom surfaces.

37. The method of claim 36, wherein repositioning the cutting edge of the bevel on the second edge occurs substantially at the same time as the repositioning of the cutting edge of the bevel on the first edge.

38. A method of reorienting a bevel on a cutting blade, the blade having a top surface, a bottom surface, and a first edge extending between the top and bottom surfaces, the first edge including a bevel defining a cutting edge, the method comprising:

reorienting the bevel such that the cutting edge is repositioned from a first location on the first edge with respect to the top and bottom surfaces, to a second location on the first edge with respect to the top and bottom surfaces;

wherein the second position is between the top and bottom surfaces.

39. The method of claim 38, wherein the first position is adjacent the bottom surface.

40. The method of claim 38, wherein the blade further includes a second edge extending between the top and bottom surfaces, the second edge including a bevel defining a cutting edge, and wherein reorienting the bevel on the first edge does not reorient the cutting edge of the bevel on the second edge.

41. The method of claim 38, wherein the blade further includes a second edge extending between the top and bottom surfaces, the second edge including a bevel defining a cutting edge, the method further including reorienting the bevel on the second edge such that the cutting edge is repositioned from a first location on the second edge with respect to the top and bottom surfaces, to a second location on the second edge that is between the top and bottom surfaces.

42. The method of claim 41, wherein reorienting the bevel on the second edge occurs substantially at the same time as the reorienting of the bevel on the first edge.

43. The method of claim 38, wherein reorienting the bevel includes changing the orientation of the bevel using a stamping die.

44. A method of manufacturing a cutting blade, the method comprising:

providing a blade having a top surface, a bottom surface, and first and second edges extending between the top and bottom surfaces, each of the first and second edges including a bevel defining a cutting edge; and repositioning the cutting edge of the bevel on the first edge from a first location on the first edge to a second location on the first edge;

wherein the second location is between the top and bottom surfaces; and wherein repositioning the cutting edge of the bevel on the first edge does not reposition the cutting edge of the bevel on the second edge.

45. The method of claim 44, repositioning the cutting edge of the bevel on the first edge is done using a stamping die.

46. The method of claim 44, wherein the first location is adjacent the bottom surface.

* * * * *